US010342373B2

(12) United States Patent
Clark et al.

(10) Patent No.: US 10,342,373 B2
(45) Date of Patent: Jul. 9, 2019

(54) MAILBOX, AND DOOR ASSEMBLY AND SUPPORT MEMBER THEREFOR

(71) Applicant: SOLAR GROUP, INC., Taylorsville, MS (US)

(72) Inventors: Virgil Keith Clark, Laurel, MS (US); Jeremy D'len Dickens, Laurel, MS (US); J. Derrick Dry, Laurel, MS (US); Brian Lavon Roney, Laurel, MS (US); Kenneth Ray Smith, Laurel, MS (US)

(73) Assignee: SOLAR GROUP, INC., Taylorsville, MS (US)

( * ) Notice: Subject to any disclaimer, the term of this patent is extended or adjusted under 35 U.S.C. 154(b) by 158 days.

(21) Appl. No.: 15/065,956

(22) Filed: Mar. 10, 2016

(65) Prior Publication Data

US 2017/0258255 A1 Sep. 14, 2017

(51) Int. Cl.
*A47G 29/12* (2006.01)
*A47G 29/122* (2006.01)

(52) U.S. Cl.
CPC ..... *A47G 29/1209* (2013.01); *A47G 29/122* (2013.01)

(58) Field of Classification Search
CPC ..... A47G 29/1209; A47G 29/122; A47G 29/124; A47G 29/20; A47G 29/30; A47G 29/126
USPC ..... 232/17, 38, 45; D99/29
See application file for complete search history.

(56) References Cited

U.S. PATENT DOCUMENTS 3,990,629 A 11/1976 Hodge
4,275,829 A * 6/1981 Johnson ..... A47G 29/1209 220/4.34
4,333,603 A * 6/1982 Carlson ..... A47G 29/1209 232/17
4,813,595 A * 3/1989 Johns, Jr. ..... A47G 29/1209 232/17
4,951,905 A 8/1990 Bronson et al.
5,337,954 A 8/1994 Kobilarcik et al.
5,575,422 A * 11/1996 Peterman ..... A47G 29/1209 232/17
D450,418 S * 11/2001 Belt ..... D99/29
6,543,680 B1 4/2003 McCormack
6,729,535 B2 * 5/2004 Lackey ..... A47G 29/1209 232/17
6,808,108 B1 * 10/2004 Turnbow ..... A47G 29/1209 232/17
7,070,090 B2 * 7/2006 Ranen ..... A47G 29/1209 232/17
7,182,244 B2 * 2/2007 Brown ..... A47G 29/1203 220/651
7,234,634 B1 * 6/2007 Payne ..... A47G 29/1209 232/17
7,931,189 B2 * 4/2011 Kalenburg ..... A47G 29/1209 109/66
8,104,732 B1 1/2012 Robinson et al.
(Continued)

*Primary Examiner* — William L Miller
(74) *Attorney, Agent, or Firm* — Eckert Seamans

(57) ABSTRACT

A support member is for a door assembly of a mailbox. The mailbox includes an enclosure member and a panel member coupled to the enclosure member. The door assembly has a door member coupled to the panel member. The support member includes a body portion structured to be coupled to the door member; and a flange portion extending outwardly from the body portion.

11 Claims, 6 Drawing Sheets

(56) References Cited

U.S. PATENT DOCUMENTS

| | | | | |
|---|---|---|---|---|
| 8,616,436 | B2 * | 12/2013 | Brewer | A47G 29/1209 232/29 |
| 9,700,166 | B2 * | 7/2017 | Farentinos | A47G 29/1209 |

* cited by examiner

MAILBOX, AND DOOR ASSEMBLY AND SUPPORT MEMBER THEREFOR

BACKGROUND

Field

The disclosed concept relates to mailboxes. The disclosed concept also relates to door assemblies for mailboxes. The disclosed concept further relates to support members for door assemblies.

Background Information

Mailboxes commonly have to pass certification tests in order to be properly certified by, for example, Underwriters Laboratories Inc. ("UL"), headquartered in Northbrook, Illinois. One reason mailboxes must pass these certification tests is that the United States Postal Service ("USPS") will not deliver parcels of mail to a mailbox that has been compromised. For example, the USPS will not deliver mail to a mailbox in which the door of the mailbox fails to close because its structural integrity has been compromised. As a result, the door of the mailbox is required to pass load and impact tests. During the load test, the door is subjected to a load over a period of time, and during the impact test the door is subjected to a sudden impact from a load. In order to be properly certified, the door must be able to pass both tests without extensively plastically deforming to the point where the door will no longer function or close. That is, the door must continue to function properly.

Additional certifications require that the interior compartment of the mailbox remain sufficiently dry, for example, after the mailbox experiences conditions typical of a storm.

There is room for improvement in mailboxes, and in door assemblies and support members therefor.

SUMMARY

These needs and others are met by embodiments of the disclosed concept, which are directed to a mailbox, and door assembly and support member therefor.

In accordance with one aspect of the disclosed concept, a support member for a door assembly of a mailbox is provided. The mailbox includes an enclosure member and a panel member coupled to the enclosure member. The door assembly has a door member coupled to the panel member. The support member comprises a body portion structured to be coupled to the door member; and a flange portion extending outwardly from the body portion.

In accordance with another aspect of the disclosed concept, a door assembly for a mailbox is provided. The mailbox includes an enclosure member and a panel member coupled to the enclosure member. The door assembly comprises a door member structured to be coupled to the panel member; and a support member coupled to the door member.

In accordance with a further aspect of the disclosed concept, a mailbox comprises an enclosure member; a panel member coupled to the enclosure member; and a door assembly comprising a door member coupled to the panel member, and a support member coupled to the door member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts.

As employed herein, the statement that two or more parts or components "engage" one another shall mean that the parts touch and/or exert a force against one another either directly or through one or more intermediate parts or components.

As employed herein, the term "coupling member" refers to any suitable connecting or tightening mechanism expressly including, but not limited to, rivets, screws, bolts, and the combinations of bolts and nuts (e.g., without limitation, lock nuts), washers and nuts, zip ties, and wire ties.

Figure 1:
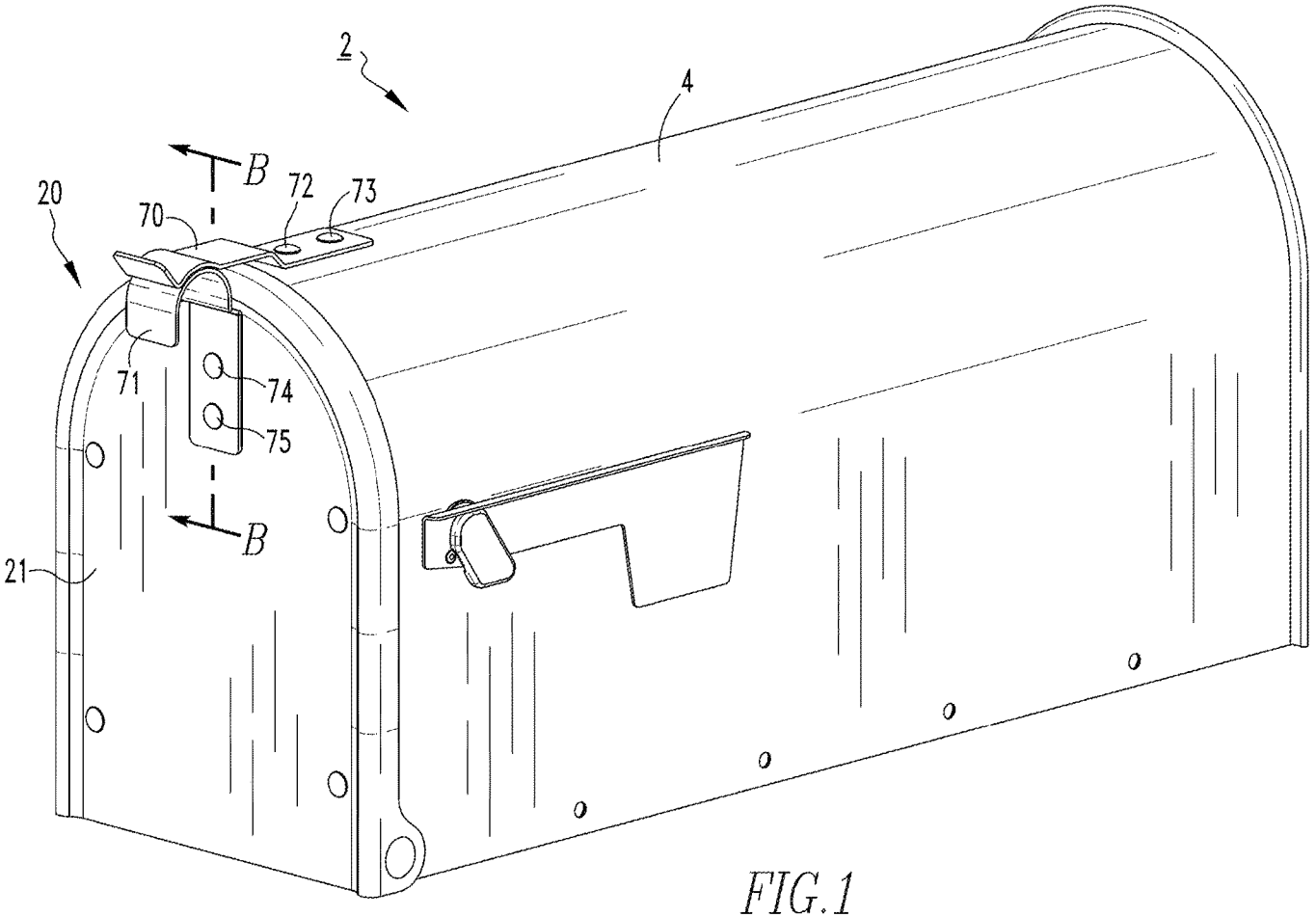
FIG. 1 is a front isometric view of a mailbox, and door assembly and support therefor, in accordance with a non-limiting embodiment of the disclosed concept.
Figure 2:
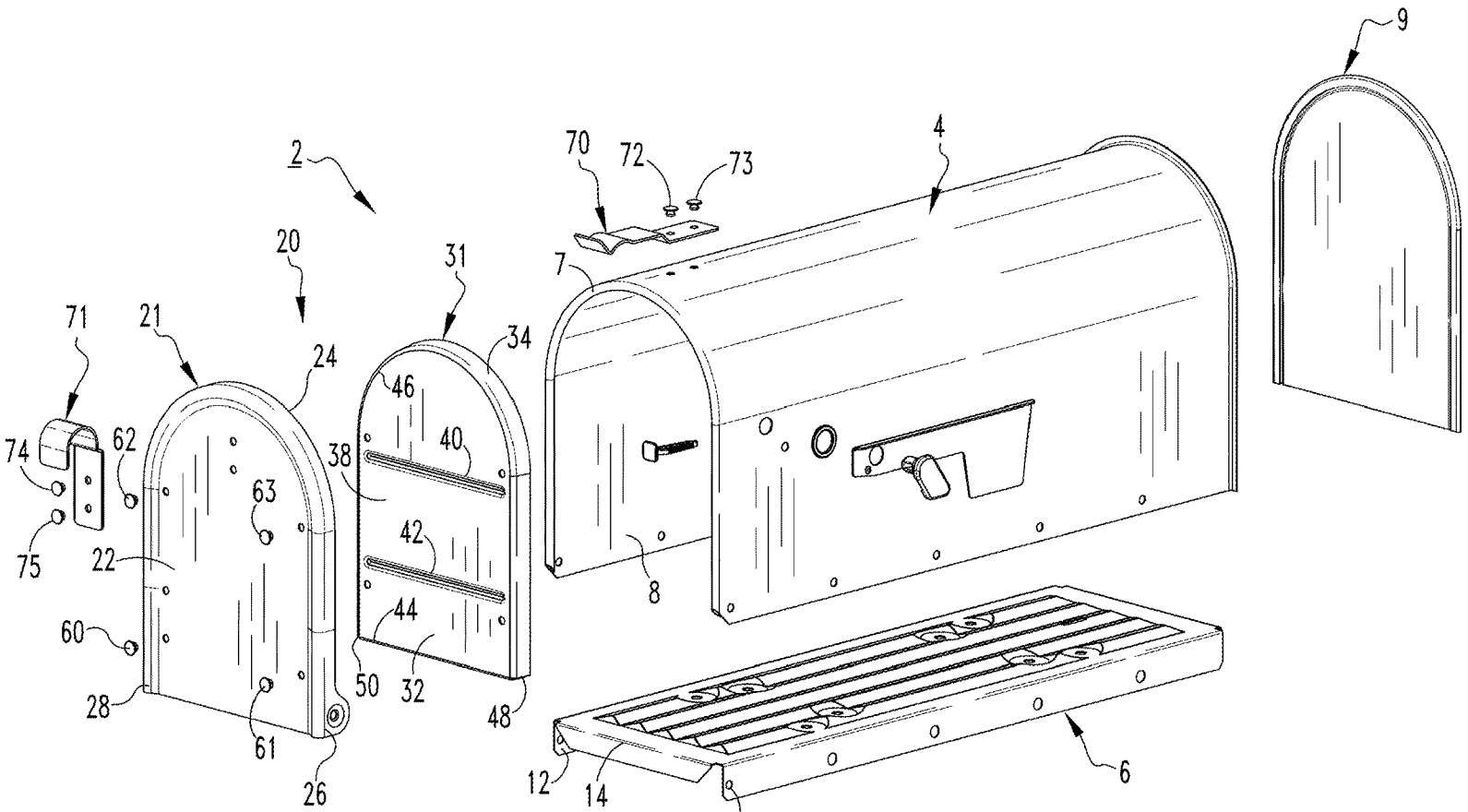
FIG. 2 is an exploded front isometric view of the mailbox, and door assembly and support member therefor of FIG. 1.

FIGS. 1 and 2 show a mailbox 2, in accordance with a non-limiting embodiment of the disclosed concept. The example mailbox 2 includes an enclosure member 4, a number of panel members 6,9 (FIG. 2) coupled to the enclosure member 4, a door assembly 20, a number of securing clip members 70,71, and a number of coupling members 72,73,74,75 for coupling the clip members 70,71 to the enclosure member 4 and the door assembly 20, respectively.

The door assembly 20 has a door member 21 coupled to the panel member 6, and a support member 31. In the example shown, the support member 31 is coupled to the door member 21 by way of a number of coupling members 60,61,62,63 extending through the door member 21 and the support member 31. It will be appreciated, however, that the support member 31, and other mailbox components (e.g., without limitation, clip members 70,71), could be coupled or attached in any other suitable manner (e.g., without limitation, welding), without departing from the scope of the disclosed concept.

As will be discussed in greater detail below, the support member 31 provides a novel mechanism for allowing the enclosure member 4 and the door member 21 to withstand greater loads, without undesirably plastically deforming, such as those that may be experienced during a load or impact test. This will allow the mailbox 2 to pass certification tests and also extend the longevity of the mailbox 2. By contrast, known prior art mailboxes (not shown) often plastically deform in response to a load or impact to such a degree that they no longer function properly. Additionally, the unique structure of the support member 31 ensures that water, such as, for example, from a storm, does not enter and/or accumulate on an interior of the door member 21 or within the interior of the mailbox 2. This is advantageous for purposes of satisfying more recent relatively stringent UL tests, and also results in the mailbox 2 being more reliable in terms of protecting parcels of mail from water damage. By contrast, known prior art mailboxes (not shown) do not satisfy the more recent relatively stringent UL tests and as a result, do not adequately protect against the undesired accumulation of moisture.

Continuing to refer to FIG. 2, the door member 21 includes a body portion 22 and a flange portion 24 extending outwardly from the body portion 22. In operation, when the mailbox 2 is closed, the flange portion 24 overlays a portion of the enclosure member 4 in order to provide an element of protection against water ingress into the interior of the mailbox 2. The panel member 6 includes a pair of opposing coupling portions 10,12 and a distal edge portion 14 extending between the coupling portions 10,12. The door member 21 also has a pair of opposing corner portions 26,28 that are each pivotably coupled to a corresponding one of the coupling portions 10,12 in order to allow the mailbox 2 to move between open and closed positions in a generally well known manner.

The support member 31 has a body portion 32 coupled to the door member 21, and a number of flange portions 34,36 extending outwardly from the body portion 32. The flange portion 34 extends from the first corner portion 26 to the second corner portion 28 of the door member 21 (FIGS. 1 and 2) and provides a mechanism for shielding and directing water, thereby resisting undesired moisture accumulation on the interior of the door member 21 or within the mailbox 2, as will be discussed below. The flange portion 36 likewise extends from the first corner portion 26 to the second corner portion 28 of the door member 21 (FIGS. 1 and 2), however, it is structured to provide a mechanism to strengthen the door member 21, as will be discussed below.

Figure 3:
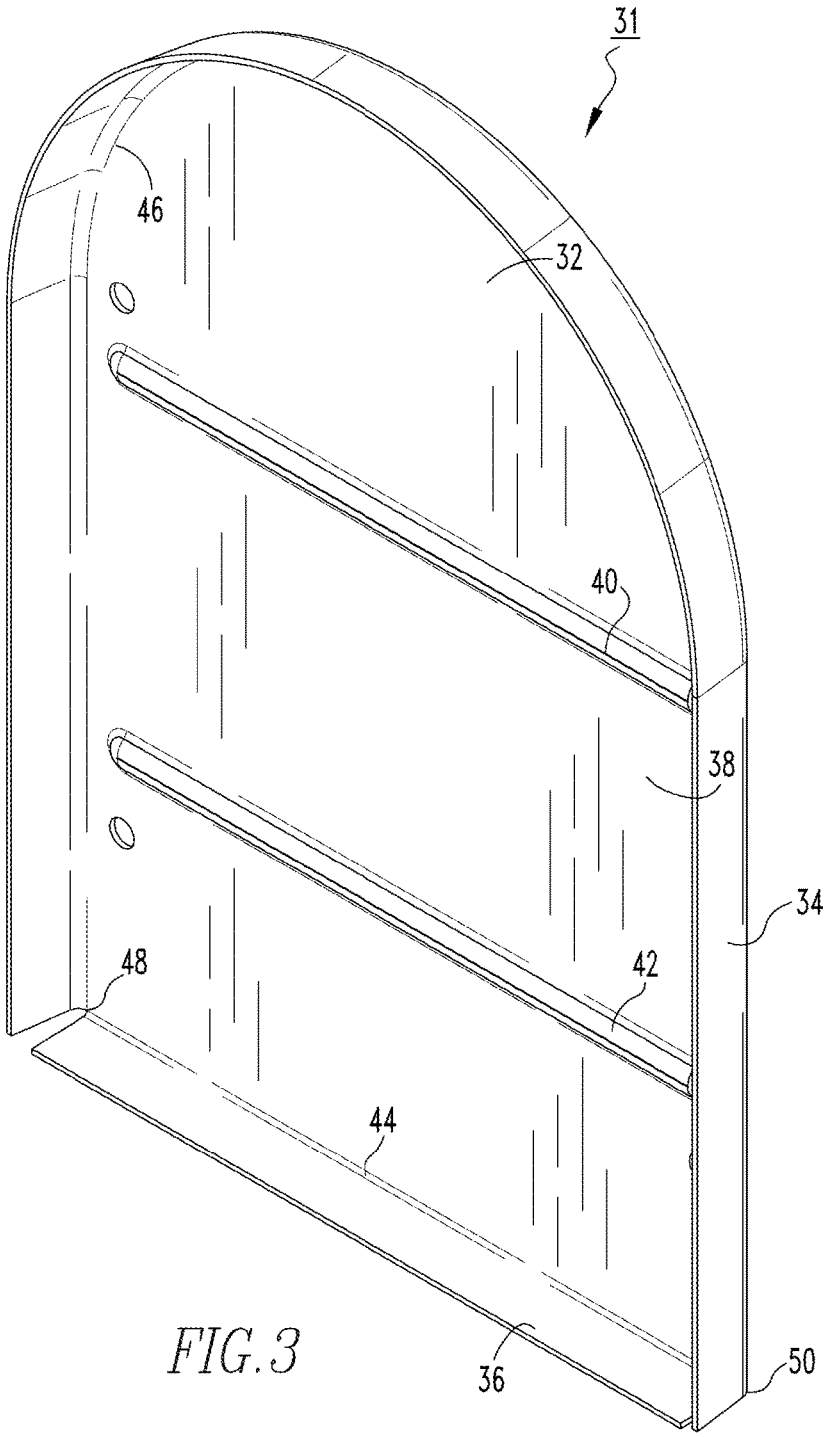
FIG. 3 is an isometric view of the support member for the mailbox of FIG. 2.
Figure 4:
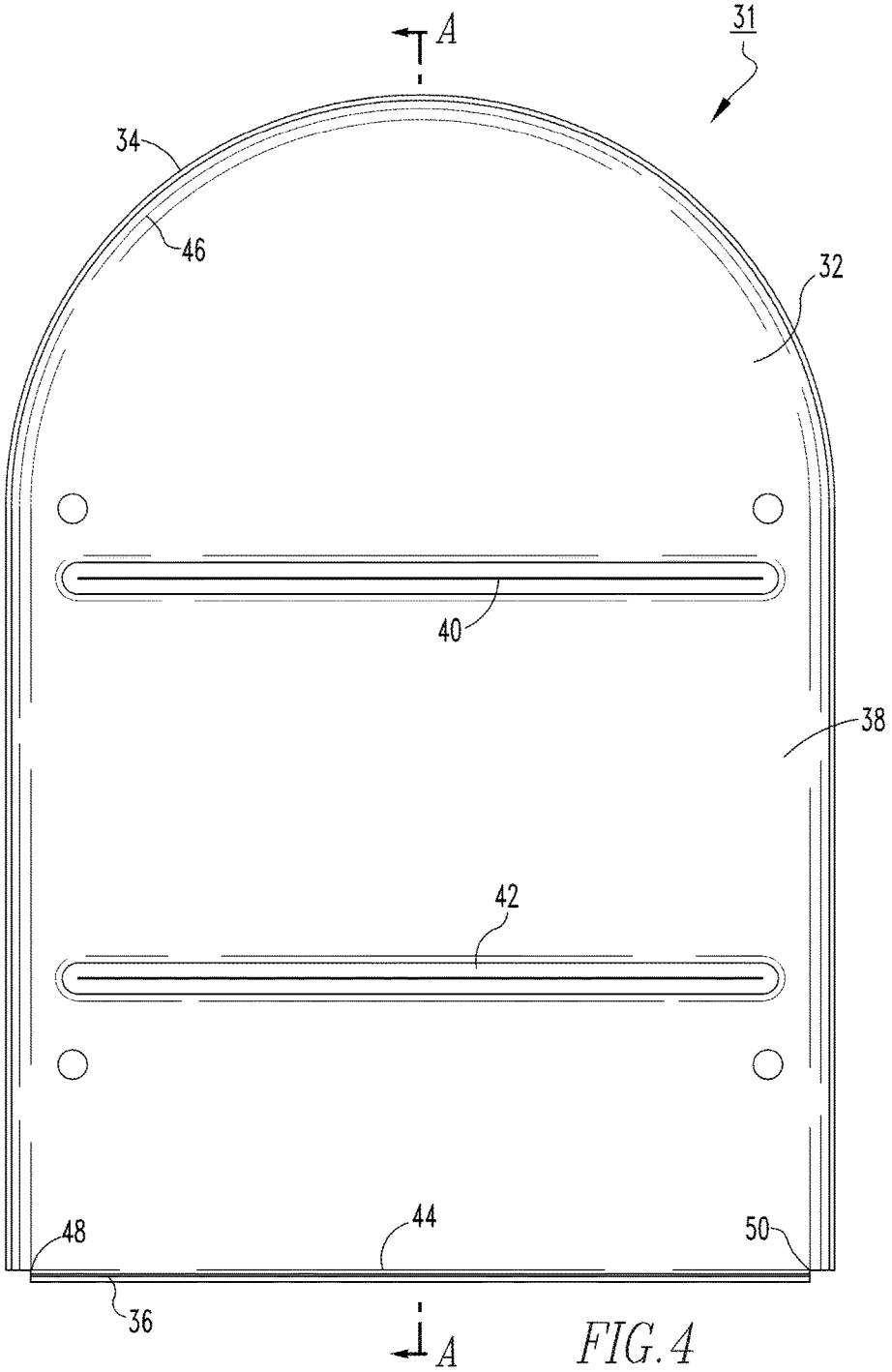
FIG. 4 is a front elevation view of the support member of FIG. 3.

As shown in FIGS. 3 and 4, the body portion 32 of the example support member 31 has a planar portion 38, a number of rib portions 40,42 extending outwardly from the planar portion 38, a linear peripheral edge portion 44, and a curvilinear peripheral edge portion 46. The linear edge portion 44 has opposing ends 48,50, and the curvilinear edge portion 46 extends from the first end 48 to the second end 50. It will be appreciated, therefore, that the support member 31 shown is generally shaped and described herein the same as the door member 21. More specifically, the planar portion 38 overlays and is flush with the body portion 22 of the door member 21. Also, the support member 31 is slightly smaller (i.e., in terms of the respective surface areas of the body portions 22,32) than the door member 21, and is located internal with respect to the door member 21, the enclosure member 4, and the panel member 6 when the mailbox 2 is closed. In this manner, almost all of the interior of the door member 21 (i.e., the body portion 22) is protected against water accumulation by virtue of the aforementioned overlapping structure and the tight fitting engagement between the planar portion 38 and the body portion 22. It will be understood, however, that a suitable alternative door assembly (not shown) could include a different relationship between the door member 21 and the support member 31 (e.g., without limitation, separated by a gasket (not shown) located therebetween), without departing from the scope of the disclosed concept.

The flange portion 34 provides the mechanism for ensuring that water is able to be removed from, or directed away from, the interior of the door member 21 and the interior of the mailbox 2. The flange portions 34,36 extend from and coincide with the respective edge portions 46,44 and are thus located at the periphery of the support member 31. When the mailbox 2 is closed, gravity will cause any water which may have undesirably entered the mailbox 2 to engage the flange portion 34. Accordingly, when the mailbox 2 is closed, the flange portions 34,36 and the rib portions 40,42 extend from the planar portion 38 toward an interior of the mailbox 2 in order to avoid undesired water accumulation, and to provide additional support for the door member 21.

Figure 5:
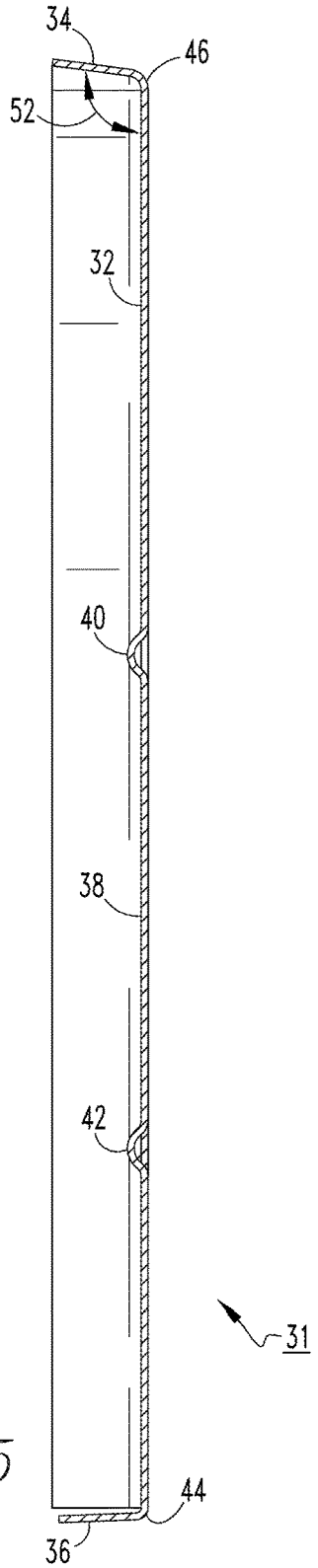
FIG. 5 is a section view of the support member of FIG. 4, taken along line A-A of FIG. 4.

First, the flange portion 34 functions as a directing portion that is structured to direct any water away from the body portion 22 and the planar portion 38 in the event that water undesirably enters the mailbox 2 during a rainstorm. In order to perform this function, the flange portion 34 is at an angle 52 (FIGS. 5 and 6) greater than 90 degrees with respect to the body portion 32 and is concave facing the linear edge portion 44. However, it will be understood that a similar suitable alternative flange portion (not shown) may have a suitable alternative geometry such as, for example and without limitation, being V-shaped, in order to perform the desired function of directing water.

Figure 6:
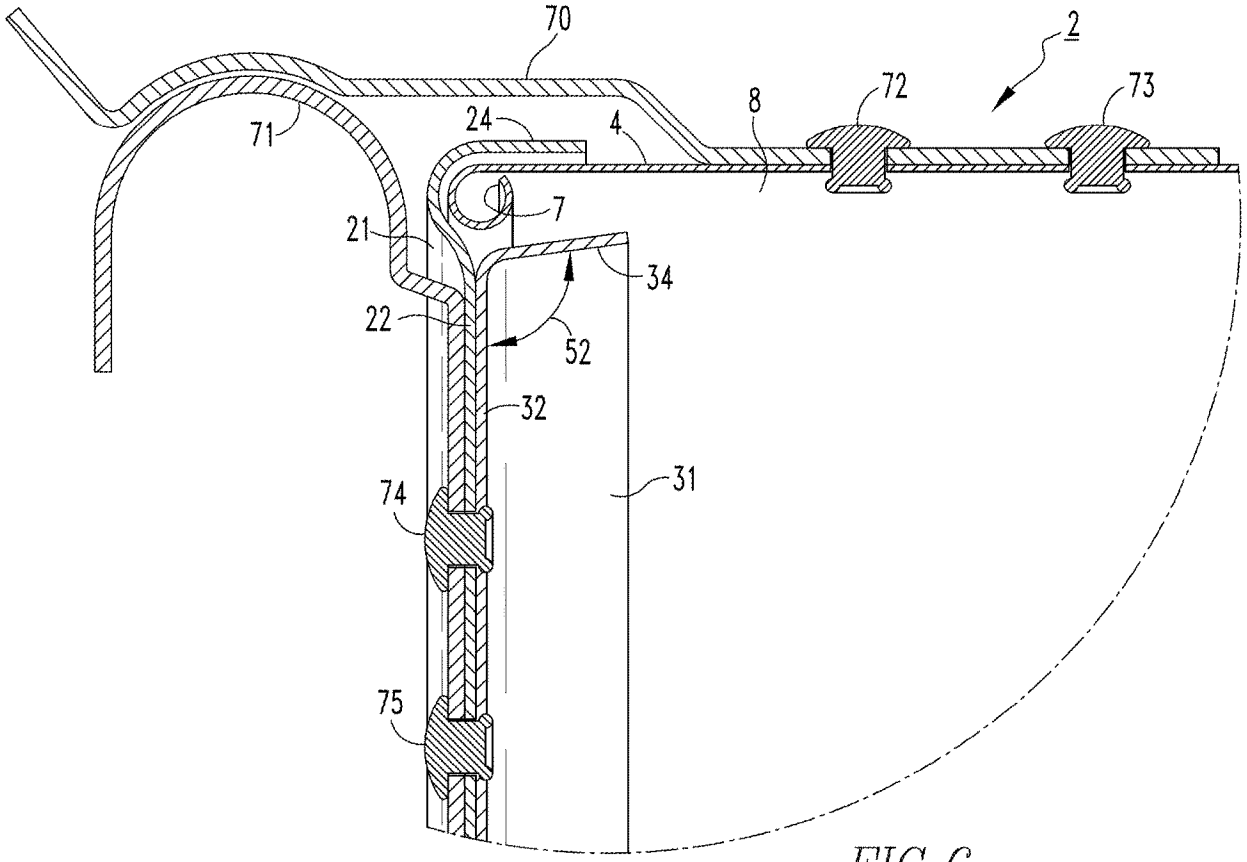
FIG. 6 is a section view of a portion of the mailbox, and door assembly and support member therefor of FIG. 1, taken along line B-B of FIG. 1.

FIG. 6 illustrates the relationship between the enclosure member 4, the door member 21, and the support member 31, when the mailbox 2 is closed. As shown, the flange portion 34 is located internal with respect to (i.e., is generally surrounded by) the flange portion 24, and the enclosure member 4 has a distal edge portion 7 (also shown in FIG. 2) that is located between the flange portions 24,34, when the mailbox 2 is closed. The edge portion 7 is also shaped substantially the same as the flange portions 24,34, as shown in FIG. 2. Additionally, the enclosure member 4 has an interior surface 8, and when the mailbox 2 is closed, the flange portion 34 extends from the body portion 32 toward the interior surface 8 (i.e., extends outwardly as a result of the angle 52 being greater than 90 degrees). This configuration allows the flange portion 34 to direct water and shield the interior of the mailbox 2, as desired.

More specifically, although the flange portion 24 provides a partial mechanism to resist water from entering the mailbox 2, there is still a possibility that water can enter between the flange portion 24 and the edge portion 7. In the event that water does enter the mailbox 2 between the flange portion 24 and the edge portion 7, rather than being deposited and remaining on the body portion 22 of the door member 21, the water will engage the flange portion 34, which will rely on its concavity with respect to the linear edge portion 44 (FIGS. 3 and 4), angular position with respect to the body portion 32 (see the angle 52 in FIGS. 5 and 6), and gravity to direct the water down, from the perspective of FIG. 6. Stated differently, gravity will cause any water that has entered the mailbox 2 between the flange portion 24 and the edge portion 7 to engage and exert a force on the flange portion 34. The corresponding opposing normal force of the flange portion 34 on the water will have a vector component directed toward the door member 21 (i.e., by virtue of the angle 52), which in the perspective shown in FIG. 6 is to the left. This operates as a barrier to resist any water from moving over the flange portion 34, and instead remain proximate the junction between the flange portion 34 and the body portion 22 of the door member 21. Additionally, because the flange portion 34 is concave facing the linear edge portion 44 (FIGS. 3 and 4) and is relatively smooth, the flange portion 34 will allow gravity to pull or direct any water down toward the spaces between the respective corner portions 26,28 of the door member 21 and the respective ends 48,50 of the support member 31, as best seen in FIG. 2. In this manner, the support member 31 resists any water from remaining on the interior of the door member 21 during a rainstorm, advantageously allowing the mailbox 2 to pass the more recent relatively stringent UL tests, as well as to better protect any parcels of mail that may be located in the mailbox 2 from exposure to water and resultant damage.

Second, as mentioned above, the support member 31 provides significant support to the enclosure member 4 and the door member 21, thereby resisting undesirable plastic deformation and allowing the mailbox 2 to pass load and impact tests, as well as last longer. The support member 31 partially achieves these benefits by substantially overlaying and engaging the body portion 22, thereby operating to buttress the door member 21 when any longitudinal loads (i.e., during testing and in standard use) are applied to the door member 21. Additionally, the support member 31 further achieves these benefits by including the rib portions 40,42 and the flange portion 36, each of which provides significant support for the door member 21 when a load is applied. The rib portions 40,42 are each generally parallel to the edge portion 44 and are centrally located in the body portion 32 (i.e., and thus a center of the door member 21). It will, however, be appreciated that a similar suitable alternative support member (not shown) may not have rib portions, or may have rib portions in any alternative number and/or configuration (e.g., without limitation, not parallel to the edge portion 44 and/or not centrally located in the body portion 32), without departing from the scope of the disclosed concept. During load and impact tests, the center of prior art door members (not shown) is the location where plastic deformation occurs most often. Accordingly, by centrally locating the rib portions 40,42, the door member 21 is significantly strengthened and provided with resistance to plastic deformation. Additionally, when the mailbox 2 is in a closed position, the support member 31 advantageously supports the distal edge portion 7 of the enclosure member 4. In this manner, the support member 31 resists undesirable permanent deformation of the enclosure member 4 when subjected to an impact or load. Functionality of the enclosure member 4 is therefore maintained. Furthermore, the flange portion 36, which overlays and is parallel with the distal edge portion 14 (FIG. 2), provides additional support for the door member 21. More specifically, during a load or impact test, and in standard use, the flange portion 36 engages a surface that exerts a normal force on the flange portion 36. The normal force is directed opposite the direction of the load and thus resists any deformation that may undesirably result in the door member 21.

Because the enclosure member 4 and the door member 21 are advantageously better supported by the novel support member 31, the onset of plastic deformation during load and impact tests, and in normal use and operation, is significantly reduced and/or eliminated. As a result, the mailbox 2 is able to pass load and impact tests, and is able to last longer by including the support member 31. Because mailboxes are commonly made of many known materials (e.g., without limitation, steel, aluminum, and plastic), it will be understood that the novel support member 31 may not be necessary for certain mailboxes to pass some load and impact tests. For example, mailboxes made of relatively thick-walled steel may not require the support member 31, while mailboxes made of aluminum or relatively thin-walled steel may require the support member 31 to pass load and impact tests. Additionally, the support member 31 may be made of any suitable material known in the art, such as, for example and without limitation, steel, aluminum, or plastic.

Accordingly, it will be appreciated that the disclosed concept provides for an improved (e.g., without limitation, stronger, better able to pass load and impact tests, and better protected from rain) mailbox 2, and door assembly 20 and support member 31 therefor, in which the support member 31 significantly strengthens a door member 21, and includes a flange portion 34 that advantageously resists water from desirably entering or accumulating on an interior portion of the mailbox 2.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A door assembly for a mailbox, said mailbox comprising an enclosure member and a panel member coupled to said enclosure member, said door assembly comprising:

a door member structured to be coupled to said panel member; and a support member coupled to said door member, wherein said support member is shaped substantially the same as said door member; wherein each of said door member and said support member comprises a body portion and a flange portion extending outwardly from said body portion; and wherein said flange portion of said support member is disposed internal with respect to said flange portion of said door member.

2. The door assembly of claim 1 wherein said body portion of said support member has a planar portion and a number of rib portions each extending outwardly from said planar portion.

3. The door assembly of claim 1 wherein said door member comprises a first corner portion and a second corner portion disposed opposite the first corner portion; wherein each of the first corner portion and the second corner portion is structured to be pivotably coupled to said enclosure member; and wherein said flange portion of said support member extends from proximate the first corner portion to proximate the second corner portion.

4. A door assembly for a mailbox, said mailbox comprising an enclosure member and a panel member coupled to said enclosure member, said door assembly comprising:

a door member structured to be coupled to said panel member; and a support member coupled to said door member;

wherein said support member comprises a body portion having a planar portion and a number of rib portions each extending outwardly from said planar portion; wherein said door member comprises a body portion overlaying said planar portion; and wherein each of said number of rib portions extends from said planar portion away from said body portion of said door member.

5. The door assembly of claim 4 wherein said support member is shaped substantially the same as said door member.

6. The door assembly of claim 4 wherein said planar portion engages and is generally flush with said body portion of said door member.

7. A mailbox comprising:

an enclosure member;

a panel member coupled to said enclosure member; and a door assembly comprising:

a door member coupled to said panel member, and a support member coupled to said door member, wherein said mailbox is structured to move between a FIRST position corresponding to said mailbox being open and a SECOND position corresponding to said mailbox being closed; wherein said enclosure member has an edge portion; wherein each of said door member and said support member comprises a body portion and a flange portion extending outwardly from said body portion; and wherein, when said mailbox is in the SECOND position, the edge portion of said enclosure member is disposed between said flange portion of said door member and said flange portion of said support member.

8. The mailbox of claim 7 wherein the edge portion of said enclosure member is shaped substantially the same as said flange portion of said door member and said flange portion of said support member.

9. A mailbox comprising:

an enclosure member;

a panel member coupled to said enclosure member; and a door assembly comprising:

a door member coupled to said panel member, and a support member coupled to said door member, wherein said mailbox is structured to move between a FIRST position corresponding to said mailbox being open and a SECOND position corresponding to said mailbox being closed; and wherein, when said mailbox is in the SECOND position, said support member is enclosed by said door member, said enclosure member, and said panel member.

10. The mailbox of claim 9 wherein said enclosure member has an interior surface; wherein said support member comprises a body portion and a flange portion extending outwardly from said body portion; and wherein, when said mailbox is in the SECOND position, said flange portion extends from said body portion toward said interior surface.

11. The mailbox of claim 9 wherein said panel member comprises a first coupling portion, a second coupling portion disposed opposite the first coupling portion, and a distal edge portion extending between the first coupling portion and the second coupling portion; wherein said door member is pivotably coupled to each of the first coupling portion and the second coupling portion; and wherein said support member comprises a flange portion overlaying and being disposed parallel with said distal edge portion.

* * * * *